US007097803B2

(12) United States Patent
Chang

(10) Patent No.: US 7,097,803 B2
(45) Date of Patent: Aug. 29, 2006

(54) PROCESS OF MAKING A CORRUGATED NET MATERIAL

(76) Inventor: Che-Yuan Chang, No. 1, Lane 147, Sec. 2, Chung San Rd., Yun Lin, Chang Hua Hsien (TW)

( * ) Notice: Subject to any disclaimer, the term of this patent is extended or adjusted under 35 U.S.C. 154(b) by 320 days.

(21) Appl. No.: 10/278,027

(22) Filed: Oct. 23, 2002

(65) Prior Publication Data

US 2003/0080468 A1 May 1, 2003

Related U.S. Application Data

(63) Continuation-in-part of application No. 09/592,111, filed on Jun. 12, 2000, now abandoned.

(30) Foreign Application Priority Data

May 18, 2000 (TW) ..... 89109540 A

(51) Int. Cl.
*B29C 53/30* (2006.01)
*B29C 53/22* (2006.01)

(52) U.S. Cl. ..... 264/282; 264/285; 264/286; 264/287

(58) Field of Classification Search ..... 264/280, 264/282, 286; 428/179, 182, 181; 15/229.14
See application file for complete search history.

(56) References Cited

U.S. PATENT DOCUMENTS 2,693,008 A * 11/1954 Upton et al. ..... 28/263
2,763,898 A * 9/1956 Sammons et al. ..... 28/265
3,022,545 A * 2/1962 Wylde et al. ..... 28/267
3,305,897 A * 2/1967 Meibohm ..... 28/267
3,499,953 A * 3/1970 Stanley ..... 264/168
3,526,023 A * 9/1970 Mertens ..... 28/248
3,763,527 A * 10/1973 Yazawa ..... 28/266
3,859,695 A * 1/1975 Erickson ..... 28/250
4,162,564 A * 7/1979 Stanley ..... 28/248
4,174,416 A * 11/1979 Mercer ..... 428/107
4,749,306 A * 6/1988 Demeny et al. ..... 405/45
4,866,822 A * 9/1989 Keedy et al. ..... 28/250
5,465,452 A * 11/1995 Girardot et al. ..... 15/210.1
5,715,561 A * 2/1998 Tuthill et al. ..... 15/229.11
5,916,408 A * 6/1999 Chen ..... 156/308.4

* cited by examiner

*Primary Examiner*—Mark Eashoo
(74) *Attorney, Agent, or Firm*—Browdy and Neimark, PLLC

(57) ABSTRACT

The present invention is to provide a process of making a corrugated net material including the following steps. First prepare a net material with an adequate length, and then heat and soften the net material by means of a heating element. March the soften net material through a gap formed by two press rollers which rotate in relative direction such that the softened net material is pressed by the two press rollers flatly. March the pressed flat net material continuously into a vessel such that the flat net material is cumulated in the vessel and squeezed by itself to form a plurality of non-directional bends. Lastly, release the squeezed net material from the vessel such that the corrugated net material is thus obtained.

4 Claims, 3 Drawing Sheets

PROCESS OF MAKING A CORRUGATED NET MATERIAL

This is a continuation-in-part of copending parent application No. 09/592,111, filed Jun. 12, 2000

FIELD OF THE INVENTION

The invention relates to a washcloth, particularly implying a method for manufacturing the corrugated net bath cloth.

BACKGROUND OF THE INVENTION

It is well known that those bath gears such as bath balls, bath gloves, band brushes, etc for washing the body in bath or shower are made of plastic net tube by technique of turning inside up, folding and the bundling in the desirable form. The net material can easily absorb the cleaning lotion to produce soap bubbles for the operator to rub or brush all over the body. The net material, made from the plastic tube, presents adequate coarse surface, conducive for rubbing the dirt of the body in bath.

Even though the surface of the bath gears made of plastic net tube offers appropriate roughness, but it is too feeble, and the corrugation is not high enough to produce the comfort in rubbing the dirtier places such as elbow or foot sole. Forceful rubbing and repeated washing are not a preferable practice the washer desires.

U.S. Pat. No. 5,916,408 discloses a method for making a mittenlike bath scrubber. According to the '408 patent, a tubular net is transformed into a wavy net by pressing and heating the tubular net through a heat rolling device. The heat rolling device includes two rolling wheels on which ribs are provided for pressing the tubular net into the wavy net when the tubular net is passed therethrough. However, the corrugation of the wavy net thus obtained is usually uniform, i.e. the variation of roughness is not enough.

SUMMARY OF THE INVENTION

It is the primary objective of the present invention to provide a novel method for manufacturing the corrugated net bath cloth with rougher surface for the fabrication of bath gears such as bath balls, bath gloves and band brushes with better rough surface to attain easier and better body washing efficiency.

To accomplish the aforesaid object, the process of making a corrugated net material comprises the steps of: preparing a net material with an adequate length; heating and softening the net material by means of a heating element; marching the soften net material through a gap formed by two press rollers which rotate in relative direction such that the softened net material is pressed by the two press rollers flatly; continuously marching the pressed flat net material into a vessel such that the flat net material is squeezed in the vessel by itself to form a plurality of bends; and releasing the bent net material from the vessel such that the corrugated net material is thus obtained.

The invention is hereby explained in greater detail with the aid of some embodiment illustrated in drawings.

DETAILED DESCRIPTION OF THE INVENTION

Figure 2:
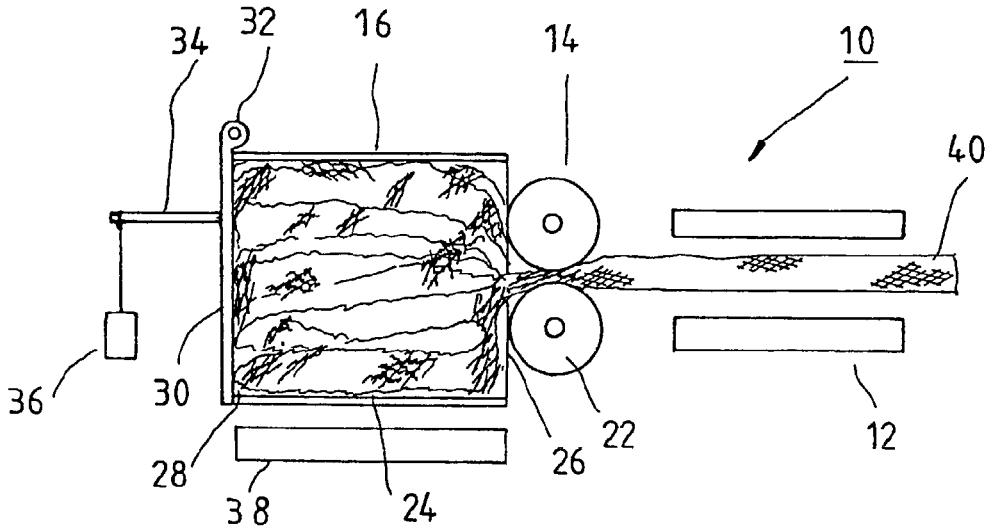
FIG. 2 displays the schematic diagram of apparatus for manufacturing such corrugated net material.

As shown in FIG. 2, the corrugated net material of the invention is manufactured on an apparatus (10). The said apparatus (10) comprises a heating element (12), a compressing device (14) composed of two press roller (22) located at the output end of the heating element (12). Two press rollers are driven by a motor (not shown on the figure) and rotate along the axial line. The surface of the press roller is of smooth copper tube. A squeeze device (16) is provided at the exit of the compressing device (14). A vessel (24) in cylindrical form having an inlet (26) aligned with the outlet of two press rollers (22), an outlet (28) and a lid (30) which swings up and down over the outlet (28) of the vessel (24). On the cantilever (32), there is a hook (34) for hanging a counter weight (36). The cantilever (32) will render a torque causing the lid (30) to seal the outlet (28). The counter weight shall have sufficient weight to keep the lid closed. The exterior of the vessel (24) is outfitted with another heating element (38) to heat the vessel (24).

Figure 1:
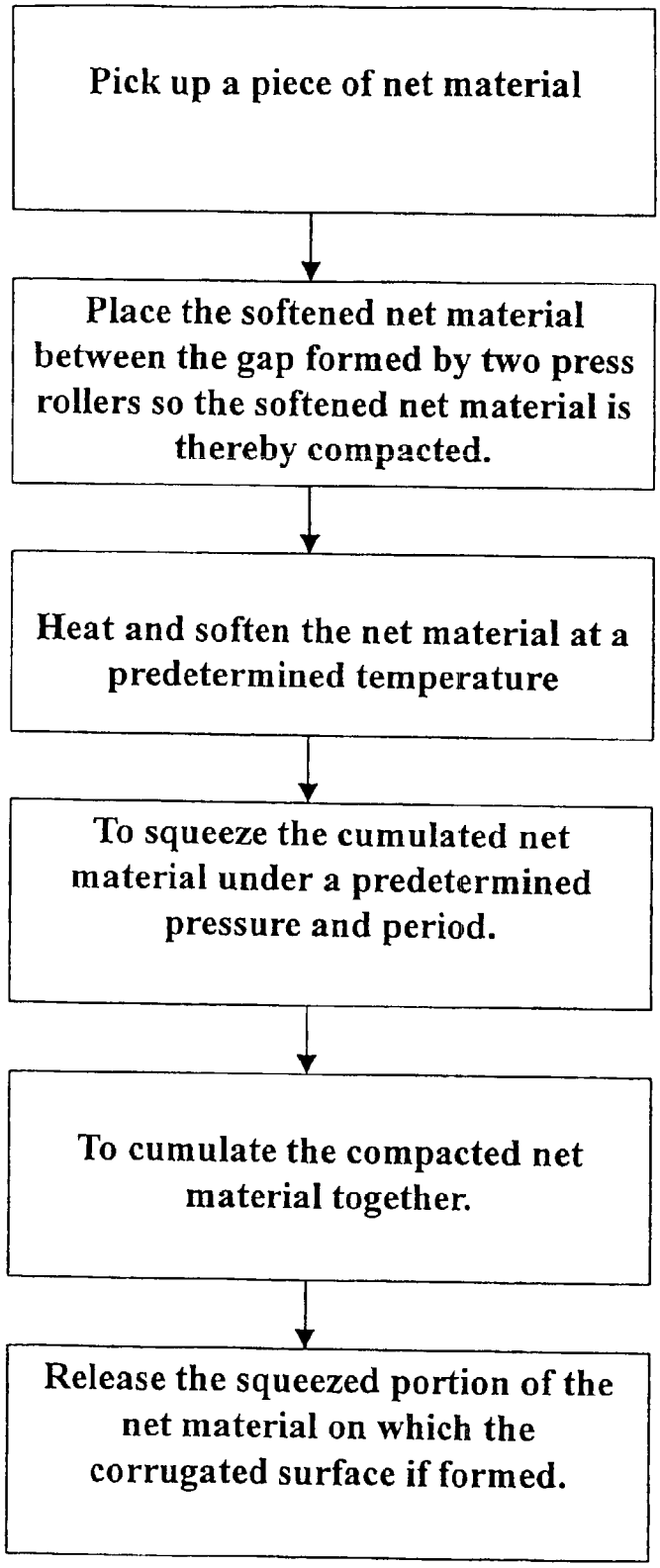
FIG. 1 shows the process flow chart.
Figure 3:
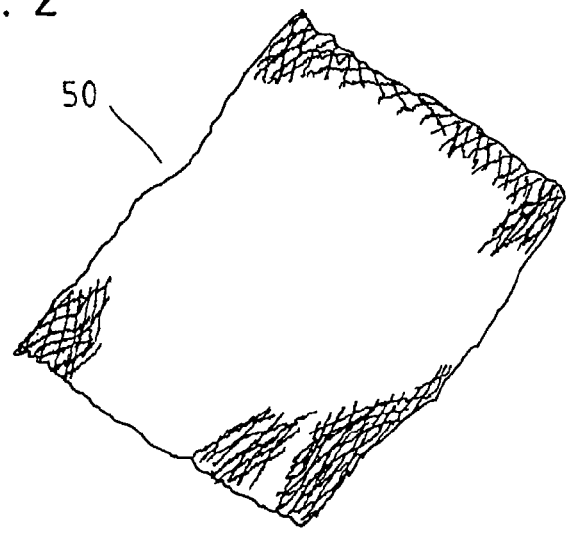
FIG. 3 shows the appearance of finished corrugated net material.

As shown in FIG. 1, the manufacturing steps are as follows:

Prepare a net material (40), preferably net tube with an adequate length, and place it over the heating element (12);

Turn on the heating element (12) to heat the net material (40) becoming soft. The temperature of the heating element (12) be set at 80° C. to 100° C. to avert the meltdown of the net material (40);

Start the compressing device (14) causing two press rollers to continue rotating with different direction, pull the softened net material (40) passing the gap of press rollers (22) and marching forward toward the vessel (24). At this moment, the net material does not become corrugated yet. Oppositely, the net material (40) becomes flat when coming out of the gap of the press rollers (22);

At this moment, the net material (40) is heated continuously by the heating element (12) and compressed by the press rollers (22) and pushed forward into the vessel (24) where the net material (40) is further cumulated, crammed and squeezed together in the vessel (24). Since the flat net material (40) received in the cabined vessel (24) is continuously squeezed and bent by itself, i.e. the following entering net material which is continuously marching into the vessel, the net material cumulated in the vessel forms itself a plurality bends which become corrugations of the net material thereafter. In other words, since the flat net material is non-directionally continuously bent in the vessel by the following entering net material, the more the net material is received/cumulated in the vessel the more the bends of the net material is formed. On the contrary, the less the net material enters into the vessel the less the bends of the net material in the vessel is formed. This helps manufacturer to easily obtain various net materials with different degree of corrugation. The vessel (24) maintains a fixed temperature inside by the heating element (38);

When the huge bulk net material (40) has cumulated in the vessel (24), subjected to dramatic squeezing, compressing, disturbance and heating, the net material is proceeding an irregular transformation;

As soon as the net material (40) constrained in the vessel (24) has gradually built up a force which is greater than that the counter weight (36) exerts on the lid (30), the net material (40) will push the lid (30) away and flees out of the vessel (24) such that the corrugated net material is thus obtained. The corrugated surface of the fled net material (50) is illustrated in FIG. 3.

Figure 4:
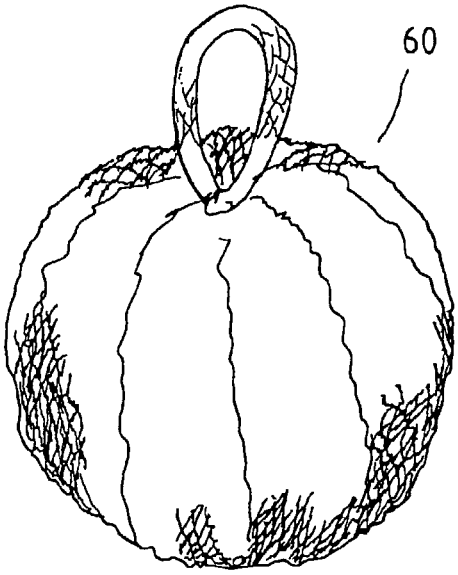
FIG. 4 shows a bath ball made from the finished corrugated net material of the invention.
Figure 5:
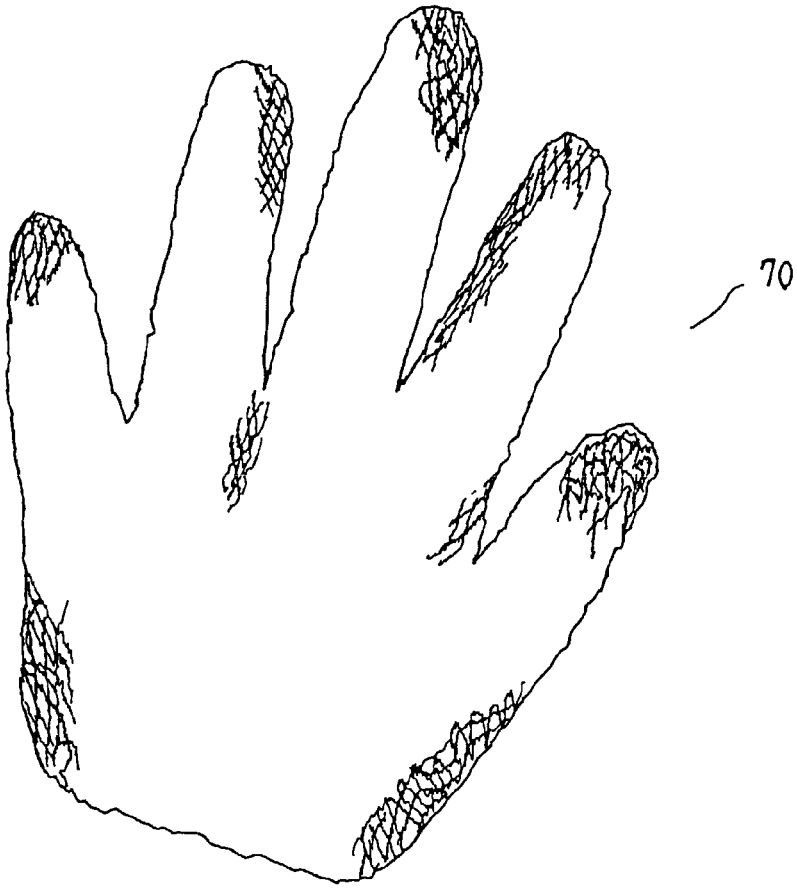
FIG. 5 shows a pair of bath gloves made from the corrugated net material of the invention.
Figure 6:
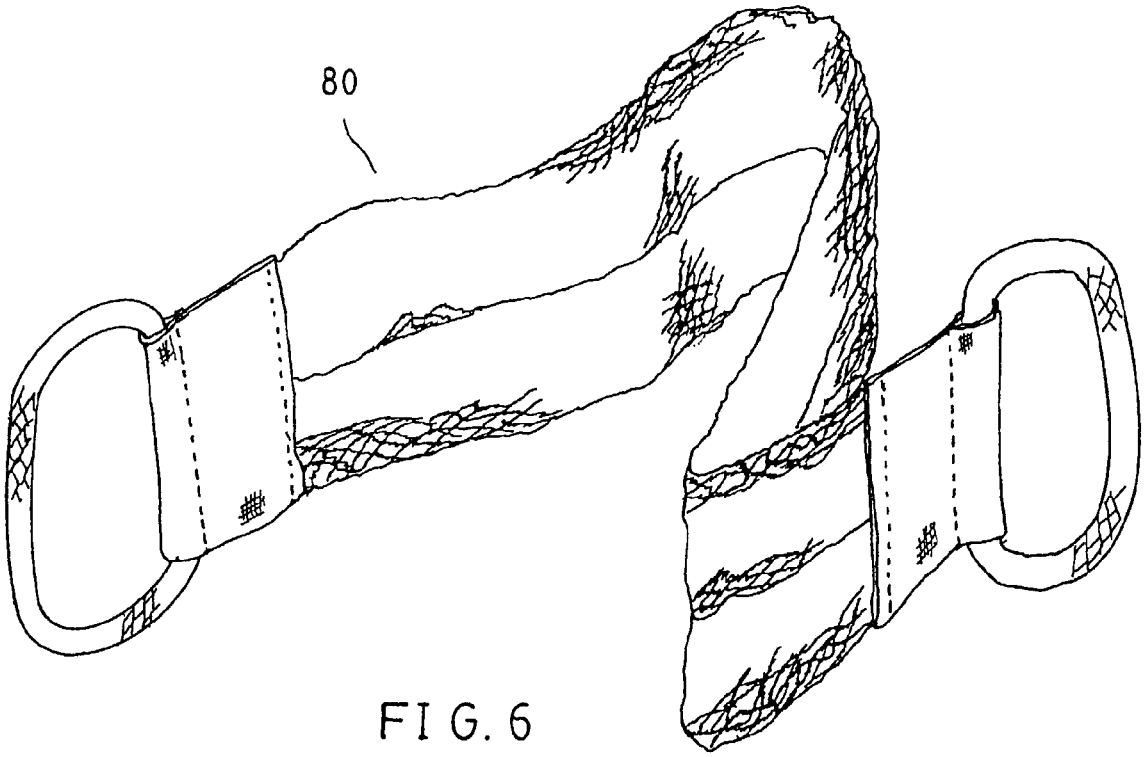
FIG. 6 shows a band brush made from the finished corrugated net material of the invention.

The said corrugated net material (50) is good material for fabrication of bath ball (60) as shown in FIG. 4, the bath gloves (70) shown in FIG. 5 and the band brush (80) shown in FIG. 6. In other words, the bath ball (60), bath gloves (70) and band brush (80) made from the corrugated net material (50) have had a rougher surface than the common plastic net material, render better performance in bath.

In addition, the surface of two press rollers can be reinforced with ribs to give the heated net material a better corrugation treatment. After ensuing squeezing and compressing works in the confinement of the vessel, the resultant the net material will have a much rougher corrugated surface.

It is also noted that if more weight is attached to the counter weight, then it requires more force form the net material in the vessel to push away the lid; it means that the longer time the net material stays in the vessel, the more squeezing and compressing the net material has to subject, the more irregular transformation will be.

What is claimed is:

1. A process of making a corrugated tubular net material, comprising the steps of:

preparing a tubular net material with an adequate length;

heating and softening the tubular net material by a heating element;

thereafter, passing the soften tubular net material without any internal support element therein through two press rollers, the press rollers spaced apart a fixed distance to permit entry of the tubular net material and rotated in relative direction so that the softened net material is flattened from a height greater than that of the fixed distance by the two press rollers to that within the fixed distance;

thereafter, passing said flattened tubular net material into a separate vessel so that the flattened tubular net material is squeezed in the vessel by itself to form a plurality of bends; and releasing the bent tubular net material from the vessel such that the corrugated tubular net material is thus obtained.

2. The process as defined in claim 1, wherein the bends formed by squeezing said flat tubular net material in the vessel are irregular and non-uniform.

3. The process as defined in claim 1, wherein said vessel has an openable lip which is covered on an outlet of the vessel though which the bent tubular net material is released.

4. A process for manufacturing a bath scrubber gear from an elongated net material capable of being softened by heat, comprising providing said elongated net material, and subjecting said elongated net material to a heat element to provide a softened elongated net material;

passing said softened elongated net material without any internal support element therein through two facing smooth-faced rotating press rollers which are spaced apart a fixed distance which permit entry of said softened elongated net material, and thereby flattening said softened elongated net material from a height greater than the fixed distance to that within said fixed distance;

thereafter, passing said flattened and softened elongated net material generally horizontally into a separate squeeze device (16) provided at an outlet end (28) thereof with a closure (30) pivoted at an upper end thereof, said closure (30) swinging up and down over said outlet (28), and accumulating, cramming and squeezing together said softened elongated net material, thus forming said net material into a plurality of non-uniform bends by irregular transformation to provide an irregularly transformed net material; and opening said closure (30) and thus releasing said irregularly transformed net material.

* * * * *